US007341446B2

(12) United States Patent
Bush

(10) Patent No.: US 7,341,446 B2
(45) Date of Patent: Mar. 11, 2008

(54) NUCLEAR RESONANCE APPLICATIONS FOR ENHANCED COMBUSTION

(76) Inventor: Gary L. Bush, 3020 NE. 32nd Ave. #902, Ft. Lauderdale, FL (US) 33308

( * ) Notice: Subject to any disclaimer, the term of this patent is extended or adjusted under 35 U.S.C. 154(b) by 302 days.

(21) Appl. No.: 10/817,539

(22) Filed: Apr. 2, 2004

(65) Prior Publication Data

US 2005/0221242 A1 Oct. 6, 2005

(51) Int. Cl.
*F23N 5/00* (2006.01)

(52) U.S. Cl. ..... 431/2; 431/75; 700/274

(58) Field of Classification Search ..... 431/2, 431/12, 75, 18; 123/536–539; 700/274
See application file for complete search history.

(56) References Cited

U.S. PATENT DOCUMENTS

| | | | | |
|---|---|---|---|---|
| 3,976,726 | A | 8/1976 | Johnson | |
| 4,064,852 | A | 12/1977 | Fulenwider | |
| 4,230,448 | A | 10/1980 | Ward | |
| 4,381,754 | A | 5/1983 | Heckel | |
| 4,728,282 | A | 3/1988 | May | |
| 5,517,975 | A * | 5/1996 | Iwata | 123/538 |
| 5,829,420 | A * | 11/1998 | Kita et al. | 123/538 |
| 6,166,541 | A * | 12/2000 | Smith et al. | 324/300 |
| 6,392,408 | B1 | 5/2002 | Barrall | |
| 6,533,963 | B1 * | 3/2003 | Schleifstein et al. | 252/511 |
| 6,581,581 | B1 * | 6/2003 | Bebich | 123/536 |
| 6,802,706 | B2 * | 10/2004 | Collesan | 431/2 |
| 6,971,376 | B2 * | 12/2005 | Monette et al. | 123/538 |
| 2003/0071619 | A1 | 4/2003 | Sauer | |

FOREIGN PATENT DOCUMENTS

| | | |
|---|---|---|
| GB | 1128493 | 9/1968 |

OTHER PUBLICATIONS

Johnston et al. "Branching Ratio in the F+HD Reaction: . . . ", J. Chem. Phys. vol. 94 No. 4, Feb. 15, 1991.
Skodje et al. "Observation of a Transition State Resonance. . . " J.Chem.Phys.vol. 112, No. 10, Mar. 8, 2000.
Anala et al. "In Situ NMR Spectroscopy of Combustion" J. Am. Chem. Soc. vol. 125, No. 43, Oct. 7, 2003.

* cited by examiner

*Primary Examiner*—Josiah C. Cocks
(74) *Attorney, Agent, or Firm*—Jack V. Musgrove

(57) ABSTRACT

A method of enhancing the combustion process by stimulating one or more components of a fuel/air mixture using nuclear resonance to selectively reduce or increase the oxidation of selected components of the combustion reaction, e.g., nitrogen (N-14) or hydrogen (H-1). The method can utilize either nuclear magnetic resonance for H-1 or nuclear quadrupole resonance for N-14. Stimulation of the components can occur before, during, or after the combustion reaction in the combustion area. Stimulation with an electromagnetic pulse can be synchronized with the combustion reaction. A feedback system is used to sense one or more operating parameters of the combustion reaction, and adjust the nuclear resonance stimulation based on sensed operating parameters. For example, if the stimulation is an RF signal having a beginning frequency, this frequency can be adjusted based on sensory information regarding gas levels or temperature in an exhaust stream.

35 Claims, 6 Drawing Sheets

NUCLEAR RESONANCE APPLICATIONS FOR ENHANCED COMBUSTION

BACKGROUND OF THE INVENTION

1. Field of the Invention

The present invention generally relates to exothermic combustion, and more particularly to a method of enhancing the combustion process to improve its efficiency and reduce the creation or emission of pollutants.

2. Description of the Related Art

Combustion is one of the oldest and perhaps most studied of all chemical reactions. From the beginning of human existence through today, combustion has been the medium of many quality-of-life improvements. It is essential to our present everyday life experience in several forms. Major subsets of combustion applications include transportation, electricity generation and indoor heating.

Combustion is an exothermic chemical reaction whereby a fuel source is oxidized. Fuel sources utilized for combustion are almost always hydrocarbon materials. The most common examples are different forms of petroleum products, such as natural gas, diesel and coal. Although each of these fuel sources contains various fractional amounts of non-hydrocarbons, carbon and hydrogen are the major fuel source components of the combustion process. In addition, various fuel sources inherently are composed of different percentages of hydrogen and carbon. For example, coal has a higher composition percentage of carbon than natural gas (methane) and vice versa for hydrogen. These fuel sources are generally oxidized by way of oxygen in the air. During the combustion process, hydrogen and carbon molecules separate and reform with unbound oxygen to form the two major by-products of combustion, carbon dioxide ($CO_2$) and water ($H_2O$).

A great amount of time, effort and capital has been invested in past attempts toward the goal of improved combustion efficiency. These efforts include a wide spectrum of approaches such as modification of the combustion process itself, to peripheral areas of improvement in combustion mechanisms and end-product delivery distribution equipment. On the surface, analysis and understanding of the basic combustion process appears fairly simple and straightforward. The reality is quite the opposite, with extremely complex chemical transformations occurring at the atomic level. Much remains unknown even today about these atomic interactions.

One serious problem with combustion that remains is the level of pollutant by-products. Coal, diesel and gas power plants produce a variety of pollutants, such as particulates, various oxides of sulfur (primarily $SO_2$, collectively referred to as SOx), and nitric oxides (NO or $NO_2$, collectively referred to as NOx). Automobiles are also known to produce high levels of NOx as well as hydrocarbons that can damage the sensitive ozone layer surrounding the Earth. Air pollution regulations have become increasingly tougher as combustion-based power production has grown. The problem is still apparent, not only in industrial centers, but in most mid-size and larger cities where smog and ozone alerts have become commonplace.

Assorted techniques have been devised to reduce combustion pollutants, by either reducing their formation during the combustion processes, or removing them from the exhaust stream. Various catalysts can also be used to reduce pollutant production. For example, a ceramic structure such as zeolite (hydrated aluminum and calcium/sodium silicate made with a controlled porosity) coated with a metal such as platinum, rhodium or palladium is commonly used to catalyze the reduction of nitric oxides.

It is difficult, however, to achieve complete (efficient) combustion combined with low NOx emissions. Sophisticated high-temperature, multi-stage combustion processes can be used, but these arrangements are typically expensive and not particularly efficient. One design which addresses these issues is shown in U.S. Pat. No. 4,728,282. The disclosed apparatus is a furnace designed to carry out a substantially isothermal combustion process using some combination of: (i) controlled radiation in the vicinity of flame emission with the combustor; (ii) temperature-responsive, controlled flow rate increase of recirculation of exhausted gases including recirculated heat and water vapor into the primary combustion zone; and (iii) controlled staged oxidation of and heat extraction from each of a plurality of oxidation or combustion zones.

Another approach to more efficient combustion and pollution control is to activate fuel components prior to combustion, as discussed in U.S. Pat. No. 3,976,726. That fuel activation apparatus subjects the fuel components to pulsed energy from an oscillator at a frequency in a range corresponding to resonant frequencies for the molecular components or constituent elements of the fuel. The operating frequency range may be expanded to include the nuclear resonance frequency for such components.

Nuclear resonance is a phenomenon associated with the protons or nuclei of an element. The nuclei of all elements carry a charge. When the spins of the protons comprising a nucleus are not paired, the overall spin of the charged nucleus generates a magnetic dipole along the spin axis. The intrinsic magnitude of this dipole is a fundamental nuclear property called the nuclear magnetic moment. Certain atoms and molecules can be excited by the application of an electromagnetic field which interacts with the magnetic dipoles formed by the nuclei. Not all nuclei possess spin (i.e., their spin number is 0), and those elements having no nuclear spin (and hence, no dipole moment) cannot be affected using nuclear resonance. Abundant elemental components of combustion that have spin numbers of 0 and therefore are not candidates for nuclear resonation include C-12 and O-16.

Nuclear magnetic resonance (NMR) utilizes a static magnetic field and a second oscillating magnetic field to perturb the nuclei of material under inspection. The rotational axis of a spinning nucleus is not orientated exactly parallel (or anti-parallel) with the direction of the applied magnetic field, but rather precesses about this field at a known angle and with an angular velocity that depends upon the magnetic moment. A given set of distinct protons transitioning between quantum states will produce an electromagnetic (sine) wave whose frequency matches their precession frequency. The effective magnetic field around a given nucleus can also be affected by the orientation of neighboring nuclei, and may lead to spin-spin coupling which splits the signal for each type of nucleus into two or more spectral lines. The signal detected at the NMR receiver thus resembles a collection of exponentially decaying sine waves, and is referred to as a free induction decay (FID). Analysis of the FID yields frequencies associated with known chemical structures. Two-dimensional spectroscopy techniques are used to determine the structure of more complicated molecules. NMR has heretofore been used primarily for imaging purposes, such as in magnetic resonance imaging (MRI) for medical diagnostics. Important elemental components of combustion susceptible to NMR manipulation include the nuclei of the H-1 isotope when combined with carbon in hydrocarbon molecules.

Some nuclei, such as nitrogen-14, possess electric quadrupole moments (non-spherical electric charge distributions). Nuclear quadrupole resonance (NQR) can be utilized on such substances. NQR is a branch of radio frequency spectroscopy that has been used quite effectively for the detection of contraband and other items of concern such as explosives. A radio frequency pulse generated by a transmitter coil causes the excitation of nuclear spins to higher quantum energy levels. When the nuclear spins return to their equilibrium position, they again follow a particular precession frequency based on their quadrupole moments. In NQR substance detection, a receiving coil is used to measure and analyze the energy released from the resonated nuclei as they return to their normal spin states. Measurement of this released energy (and/or relaxation time constants) can indicate not only which nuclei are present but also their chemical environment. The environmental variables of temperature, pressure, and molecular composition (as opposed to free-form or unbound atoms) will alter the resonant frequencies and spin relaxation times of otherwise identical isotopes of NMR/NQR receptive elements.

Relaxation times are inherently much shorter in the science of NQR as opposed to NMR. Therefore, this is a critical consideration in the placement of NMR/NQR components in various combustion enhancement systems. Exact relaxation times for different combustion techniques can vary considerably; however, for the combustion techniques contemplated by the present invention, it is believed that they are approximately 1 second for NMR targeted substances and 0.001 second for NQR targeted substances. Two general problems with NQR relate to the long recovery time of the signal stimulus/receiver coil (ring-down), and the echoing of input signals off metallic objects.

While NMR and NQR have proved valuable in such applications as imaging and identification of chemical structures, these techniques have not been effectively applied to the combustion process itself. It would, therefore, be advantageous to devise a method of enhancing the combustion process to reduce the formation or emission of pollutants using nuclear resonance. It would be further desirable if the method could enhance combustion efficiency as well.

SUMMARY OF THE INVENTION

It is therefore one object of the present invention to provide an improved method for carrying out a combustion process.

It is another object of the present invention to provide such a method which reduces the formation or emission of pollutants such as nitric oxides.

It is still another object of the present invention to provide such a method which improves the efficiency of the combustion process.

It is yet another object of the present invention to provide such a method which can be implemented in a variety of combustion applications.

The foregoing objects are achieved in a method of carrying out a combustion process, by introducing a fuel/air mixture into a combustion area and stimulating one or more components of the fuel/air mixture using nuclear resonance to alter the oxidation of one or more selected components of the combustion reaction, e.g., to reduce oxidation of nitrogen (N-14), or to increase oxidation of hydrogen (H-1). The method can utilize either nuclear magnetic resonance for H-1 or nuclear quadrupole resonance for N-14. Stimulation of the components can occur before, during, or after the combustion reaction in the combustion area. The stimulation can be emitted in an electromagnetic pulse which is synchronized with the combustion reaction. A feedback system is advantageously used to sense one or more operating parameters of the combustion reaction, and adjusting the nuclear resonance stimulation based on sensed operating parameters. For example, if the stimulation is an RF signal having a beginning frequency, this frequency can be adjusted based on sensory information regarding gas levels or temperature in an exhaust stream.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
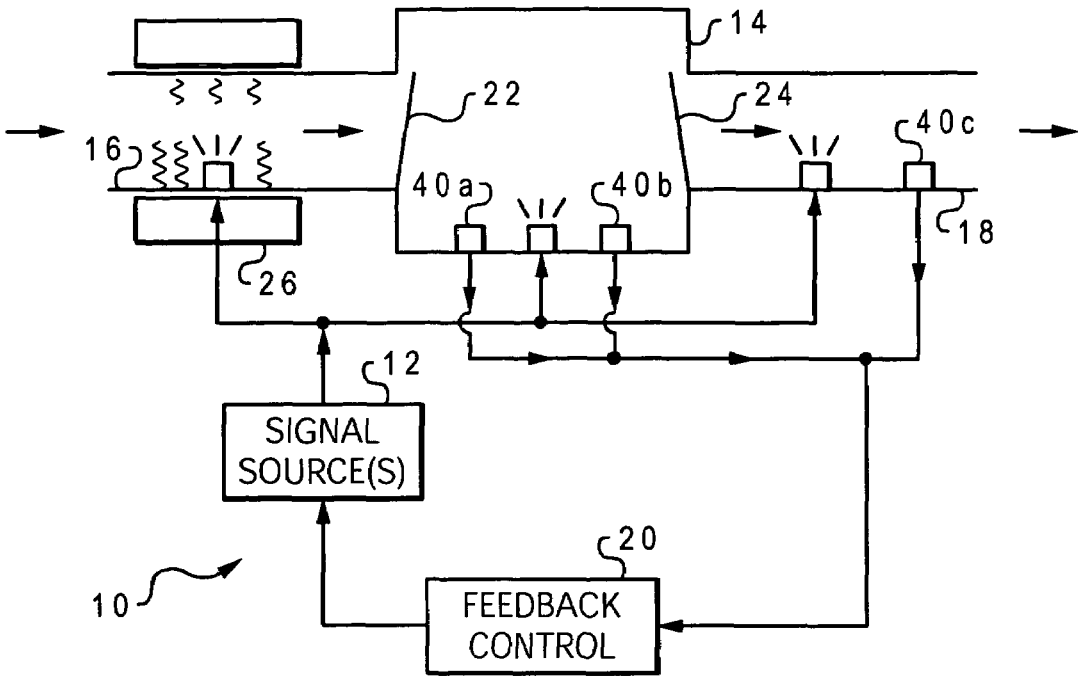
FIG. 1 is a schematic diagram of one embodiment of a combustion apparatus constructed in accordance with the present invention.

With reference now to the figures, and in particular with reference to FIG. 1, there is depicted one embodiment 10 of a generalized combustion apparatus constructed in accordance with the present invention. Combustion apparatus 10 is generally comprised of a nuclear resonance stimulation source 12, a combustion chamber 14, an intake port 16, an exhaust port 18, and a feedback control unit 20. As used herein, the term "combustion chamber" denotes the physical area of an overall combustion system where combustion takes place. It is not to be meant to be construed in the limiting sense of an enclosed space. Various combustion systems will encompass combustion chambers that are both periodically enclosed from the intake and exhaust ports during their function (internal combustion) and some that are continuously open to these ports. As explained in further detail below, the present invention is applicable to a wide variety of combustion applications, e.g., furnaces, turbines, motors, engines, and smokestacks, but the general principles of operation for each of these applications may be understood with reference to the combustion apparatus schematically shown in FIG. 1.

Intake port 16 feeds a mixture of fuel and air to combustion chamber 14. The fuel may be any combustible fluid material, e.g., a gas such as methane or propane, or a finely dispersed (aerosol) liquid such as gasoline or diesel. Ambient air can be used, or a special air source can be provided. Combustion apparatus 10 may include other features known in the art to feed the fuel and air to intake port 16, such as a carburetor, fuel injector, pre-heaters, etc. Those elements are not described here as they are not directly relevant to the present invention, but such details will become clear to those skilled in the art upon reference to this disclosure.

Combustion chamber 14 has two or more valves or gates 22, 24 which regulate the flow of the fuel/air mixture through intake port 16 and the exhaust gases through exhaust port 18. Combustion chamber 14 may further include an ignition mechanism which initiates the combustion reaction of the fuel/air mixture. The ignition mechanism may be, for example, a sparking device or pilot flame. For an application using fuels such as diesel, no ignition mechanism may be necessary, as the energy required to begin the combustion reaction may be derived from the heat of compression of the fuel/air mixture. In this regard, combustion chamber 14 may have other moving parts, such as turbines or pistons, to harness the energy (pressure) produced by the combustion reaction. Combustion chamber 14 may also include other features known in the art, such as partial recirculation of exhaust gases to increase the overall efficiency of the combustion process. For an indoor heater application, external heating fins or projections may be incorporated into combustion chamber 14 which transfer heat from the chamber to a ventilation stream. Electromagnetic deflection or absorbing materials may be included in the construction of combustion chamber 14 to further amplify the resonance effect, or for safety reasons.

Exhaust port 18 carries the exhaust gases away from combustion chamber 14. The exhaust port may take various forms such as a manifold, fan or smokestack. Other anti-pollution control devices may be used at or following exhaust port 18 to reduce or eliminate certain pollutants from the exhaust flow as known in the art.

Nuclear resonance stimulation source 12 emits electromagnetic pulses adapted to stimulate certain nuclei associated with enhanced combustion efficiency such as hydrogen (H-1) or pollutant formation, such as nitrogen (N-14). While source 12 may be a nuclear magnetic resonance (NMR) device, the preferred embodiment instead utilizes a nuclear quadrupole resonance (NQR) source in the combustion chamber, for the purpose of resonating the N-14 isotope when combined in the $N_2$ molecule, and in the exhaust port, for the purpose of resonating N-14 when combined in the NO and $NO_2$ molecules. In more complicated embodiments, a combination of these two stimulation sources may be used, for example, NMR in the fuel intake for the purpose of resonating H-1 as it is combined within various hydrocarbon molecules, NQR in the combustion chamber, and NQR in the exhaust. For such an embodiment, magnets 26 or a metallic coil capable of producing a similar desired magnetic field can be incorporated into the appropriate portion of combustion apparatus 10. Although the release of energy from resonated H-1 will occur outside this magnetic field and desirably within the combustion chamber (not a normal procedural practice for any traditional NMR applications), the induced magnetic effects occurring during the intake phase, which are necessary for the resonation of H-1, are anticipated to endure throughout the assumed normal spin relaxation times. The NMR signal source(s) can be located sufficiently close to the combustion area, i.e., such that the travel time of the stimulated hydrocarbons is less than the relaxation time(s).

Targeted stimulation with either NMR or NQR can be used to prevent the formation of or assist in the breakup of molecular bonds when they are in weakened, unstable or transitional formation states, particularly hydrocarbon molecules when exposed to thermal energy or NOx molecules which are unstable until rapidly cooled. Resonating an element of the mixture temporarily alters the electrical field around the atom/molecule, and may further alter the fields of other surrounding atoms/molecules, including dissimilar elements. Such stimulation can therefore both hinder the formation of nitric oxides, as well as reduce the probability that $N_2/O_2$ threshold collision energies necessary for molecular formation will be achieved. Additionally, nuclear resonance of the combustion mixture can reduce the overall turbidity of the mixture, thereby resulting in a more complete, uniform and controlled chemical reaction. The present invention is particularly applicable to higher temperature combustion which presently results in unacceptably elevated levels of nitric oxides.

Nitrogen, while not a major contributor to the combustion process itself, is an excellent target for NQR manipulation. The N-14 isotope (with a spin of 1 and an abundance of 99.6%) composes a large portion of the air intake mixture in the combustion process. In fact, nitrogen in the form of $N_2$ makes up over 78% by volume of the present day Earth's atmosphere. Also, its distribution in the air is uniform up to very high altitudes. Nitrogen is a generally inert element, although during combustion it sometimes combines with oxygen to form the undesirable nitric oxide by-products. Since nitrogen is one of the few elements in the mixture with a tumbling nucleus, briefly stabilizing it during combustion may promote a more stable and subsequently more efficient reformation of carbon, hydrogen and oxygen molecular end products. Nuclear resonance therefore additionally imparts an increased efficiency to the combustion process because uniformity allows more opportunities for the desired molecular formations to occur. Finally, since nitric oxide formation is reduced, there is a small increase in the total amount of $O_2$ available for hydrocarbon bonding which further contributes to the improvement of overall combustion efficiency.

Figure 2:
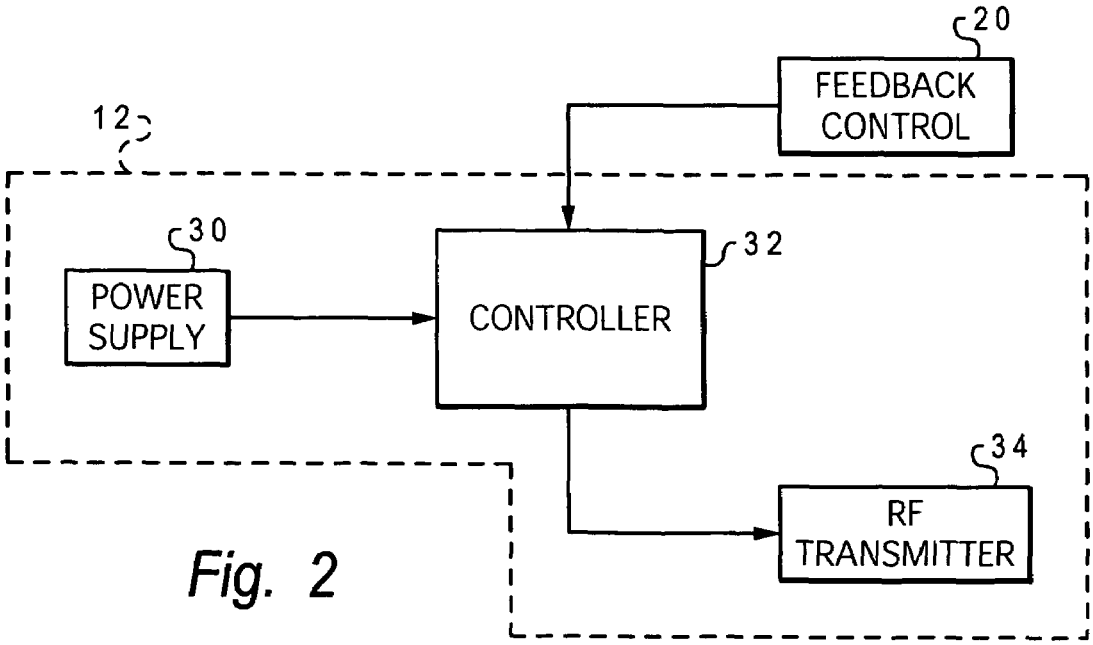
FIG. 2 is a block diagram of one embodiment of a nuclear resonance stimulation source used in the combustion apparatus of FIG. 1.

Referring now to FIG. 2, there is depicted one embodiment of an NQR device which can be used for the nuclear resonance stimulation source. NQR device 12 includes a power supply 30, a controller 32, and an adjustable frequency signal source 34 (e.g., RF transmitter) having the capability of providing pulsed signals as well as an adjustable signal strength. Controller 32 (e.g., an integrated circuit) adjusts the signal frequency of signal source 34, as well as the signal strength and pulse interval. Signal source 34 may be operated in a fixed mounted or an oscillating (sweeping) manner. In the preferred embodiment, controller 32 sets these parameters responsive to one or more signals from feedback control unit 20. As explained further below, controller 32 can set the parameters based on sensor readings indicative of combustive temperature and pressure, as well as post-combustion information such as gas content in the exhaust flow. Controller 32 may further include state-of-the-art filtering, logic and other known operational improvements that aid its overall function in tuning the output of signal source 34. Controller 32 may set signal source 34 to operate in a continuous, rather than pulsed, manner. Multiple controllers 32 and signal sources 34 may be utilized in the same combustion apparatus and at the same time for achieving the particular desired results. The resonant signal may be synchronized with the combustion process, i.e., to occur just before, during, or shortly after ignition or the peak temperature stage of the combustion process depending upon the particulars of the physical construction of the chamber, the fuel/mixture used, intended result, etc. If the resonant energy input signal is delivered during the exhaust phase, it should occur before rapid cooling of the newly formed nitric oxide molecules takes place. Input signal frequencies for all combustion applications are at or near the resonant frequencies of the targeted element or molecule, e.g., N-14, adjusted for any significant environmental influences. While the present invention is considered particularly useful in stimulating nitrogen nuclei during or after combustion, those skilled in the art will appreciate that it is applicable as well to a wide range of elements that are susceptible to nuclear resonance stimulation, e.g., the 199 and 201 isotopes of mercury (Hg).

Figure 3A:
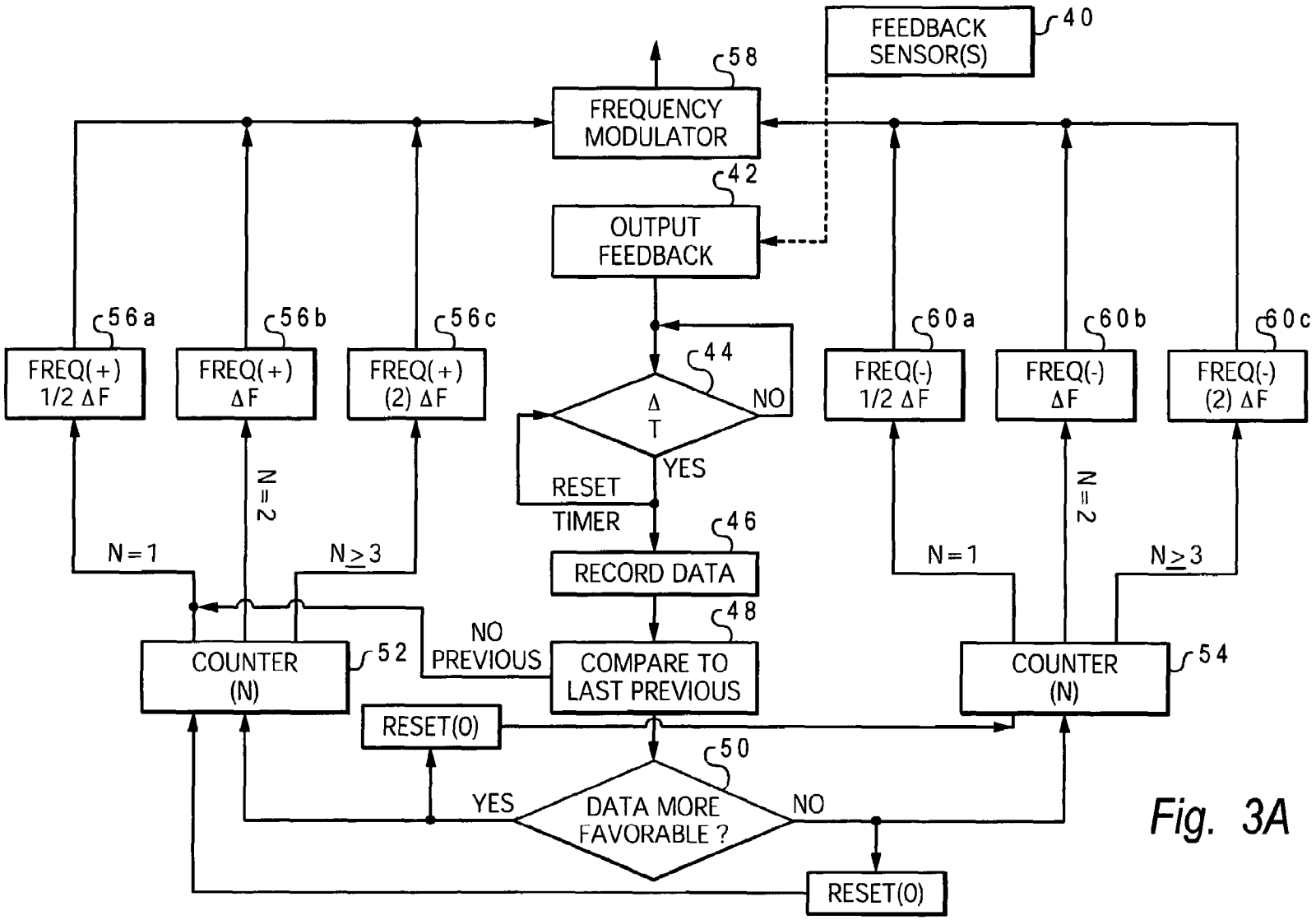
FIGS. 3A and 3B are block diagrams illustrating the feedback logic used by a feedback control unit in the combustion apparatus of FIG. 1 according to one implementation of the present invention to adjust an input signal frequency of the nuclear resonance stimulation source.
Figure 3B:
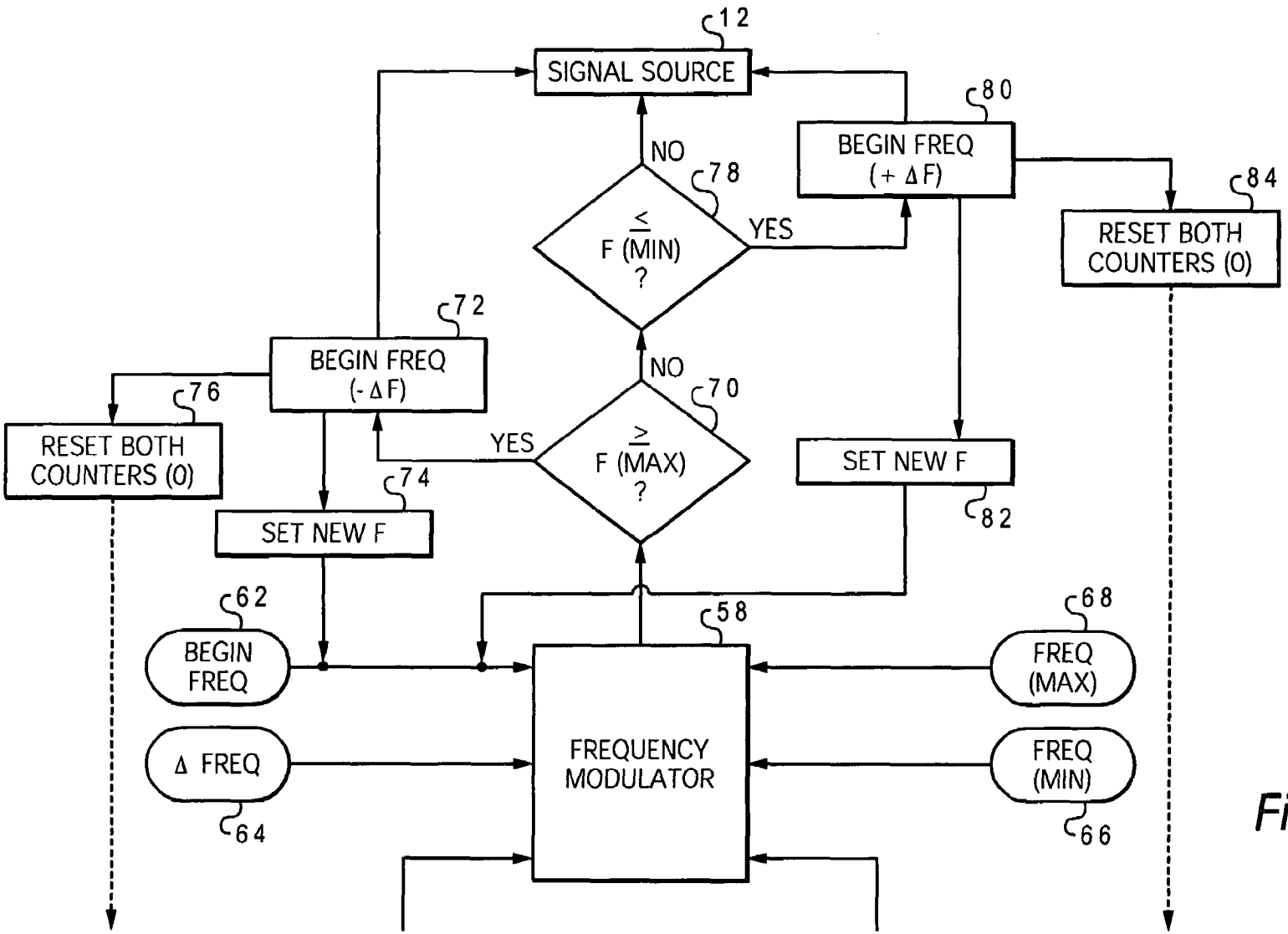

FIGS. 3A and 3B illustrate one example of the feedback logic for feedback control unit 20, which is embodied in an electronic circuit such as a programmable logic array. Feedback control unit 20 iteratively receives input signals from several sensors, including in situ combustion sensors 40*a* and 40*b* which are indicative of the pressure and temperature, respectively, of the internal combustion chamber, and one or more post-combustion sensors 40*c* which are indicative of the gas content in the exhaust stream, e.g., NOx or $CO_2$. Additional sensors may be utilized, such as a sensor which determines the post combustion temperature. Feedback control unit 20 receives these sensory input signals and determines the optimum (or near-optimum) operating parameters for NMR/NQR device 12. Corresponding output signals are forwarded to controller 32 which then adjusts the performance of signal source 34 accordingly to achieve the required resonant frequency stimulus.

As seen in FIG. 3A, the sensory outputs are stored in an output feedback buffer 42 but are not necessarily sampled continuously. Buffer 42 can optionally perform other signal conditioning such as averaging. A timer 44 is used to iteratively check buffer 42 until a preset time has passed. This time period (ΔT) preferably represents the travel time of the fuel/air mixture or exhaust stream between the signal source and the sensor, and varies according to the particular application, e.g., 1 second for a car engine, or 10 seconds for a smokestack. Once the time has elapsed, the current sensory data are recorded in memory 46, and compared to data from a previous cycle 48. If the current data are more favorable than the previous data 50, then a first counter 52 is incremented while a second counter 54 is reset, and the frequency of NMR/NQR device 12 is adjusted upwardly based on the counter value after incrementing. The determination of when data are more favorable depends upon the application; for example, a sensor output indicating that the NOx levels have dropped in the exhaust could be used to conclude that the current data are more favorable. In this implementation the frequency is increased by an amount of ½ ΔF (56*a*) when the counter value is 1, while the frequency is increased by an amount of ΔF (56*b*) when the counter value is 2, and the frequency is increased by an amount of 2×ΔF (56*c*) when the counter value is 3 or more. The value of ΔF can again vary depending upon the application. For use in targeting N-14, an exemplary value of ΔF is about 5 kilohertz. A corresponding frequency adjustment signal is fed to a frequency modulator 58. Frequency modulator 58 adjusts the starting frequency of the RF transmitter by the amounted indicated by the frequency adjustment signal. Conversely, if the current sensory data are less favorable than the previous data, then the second counter 54 is incremented while first counter 52 is reset, and the frequency of NQR device 12 is adjusted downwardly based on the counter value after incrementing. In this implementation the frequency is decreased by an amount of ½ ΔF (60*a*) when the counter value is 1, while the frequency is decreased by an amount of ΔF (60*b*) when the counter value is 2, and the frequency is decreased by an amount of 2×ΔF (60*c*) when the counter value is 3 or more. In this manner, the optimal (or near-optimal) resonant frequency is reached based on real-time feedback. These values are not meant to be limiting as the fractional portions of ΔF to be adjusted could be different, and more or less than three adjustment indications could be provided.

Referring now to FIG. 3B, frequency modulator 58 has four programmable inputs for setting the beginning frequency 62, for setting ΔF 64, and for setting minimum and maximum frequencies 66, 68. Frequency minimum and maximums 66, 68 are ideally manually readjusted periodically to optimize efficiency. An exemplary starting frequency for N-14 is 30 megahertz, with corresponding minimum and maximum frequencies of one MHz and 50 MHz. Frequency modulator 58 receives the frequency adjustment signal as explained above, and increases or decreases the beginning frequency by the indicated amount based on the value of ΔF. However, if the adjusted frequency ends up being greater than the maximum frequency 70, then the feedback system resets, by calculating a new beginning frequency 72, and setting frequency modulator 58 to use the new beginning frequency 74. In this implementation, the new beginning frequency is the old beginning frequency decreased by ΔF when the maximum frequency was exceeded. Both of the counters are reset as well 76. Similarly, if the adjusted frequency ends up being less than the minimum frequency 78, then the feedback system again resets, by calculating a new beginning frequency 80, and setting frequency modulator 58 to use the new beginning frequency 82. In this implementation, the new beginning frequency is the old beginning frequency increased by ΔF when the minimum frequency parameter was exceeded. If the adjusted signal is below $F_{max}$ and above $F_{min}$, then it is fed to signal source 12.

Figure 4:
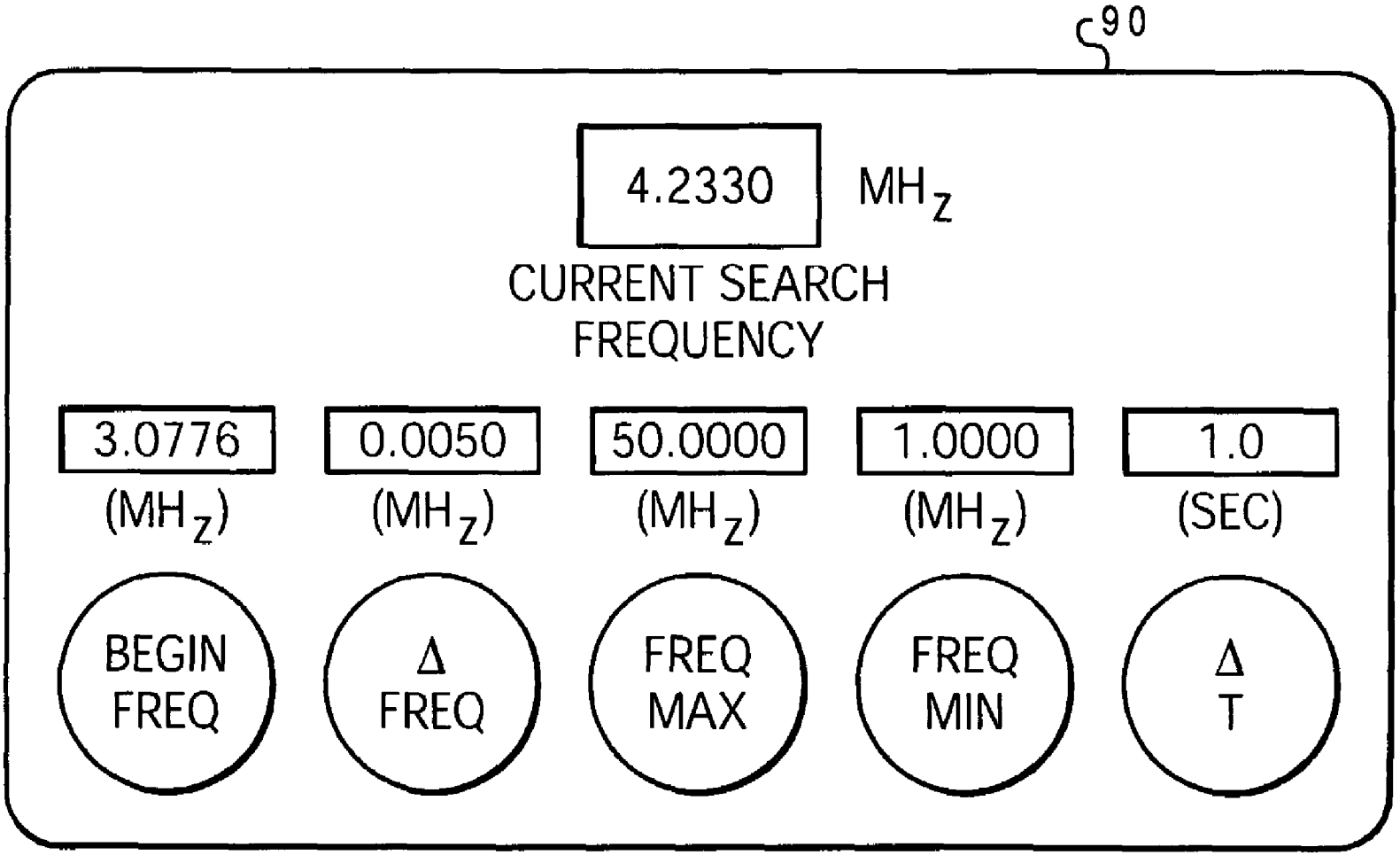
FIG. 4 is a plan view of one embodiment of a user interface which may be used with the feedback control unit to input various operational parameters.

FIG. 4 illustrates one user interface which may be used with feedback control unit 20. The user interface includes one or more display fields (e.g., liquid crystal displays) and one or more buttons or knobs for inputting the various programmable values. In this example, there are five input knobs, with five corresponding display fields, for entering the beginning frequency, ΔF, $F_{max}$, $F_{min}$, and ΔT. A sixth display field shows the current frequency which is being sent to signal source 12.

While the foregoing description describes a single frequency output for nuclear resonance stimulation source 12, more than one molecule in the fuel or effluent can be simultaneously targeted by utilizing more than one stimulus frequency. Such an implementation can utilize two or more stimulation sources with two or more corresponding feedback systems. The frequency input can also be manually controlled via the user interface based on feedback from human observation such as flame, smoke or soot characteristics.

Figure 5:
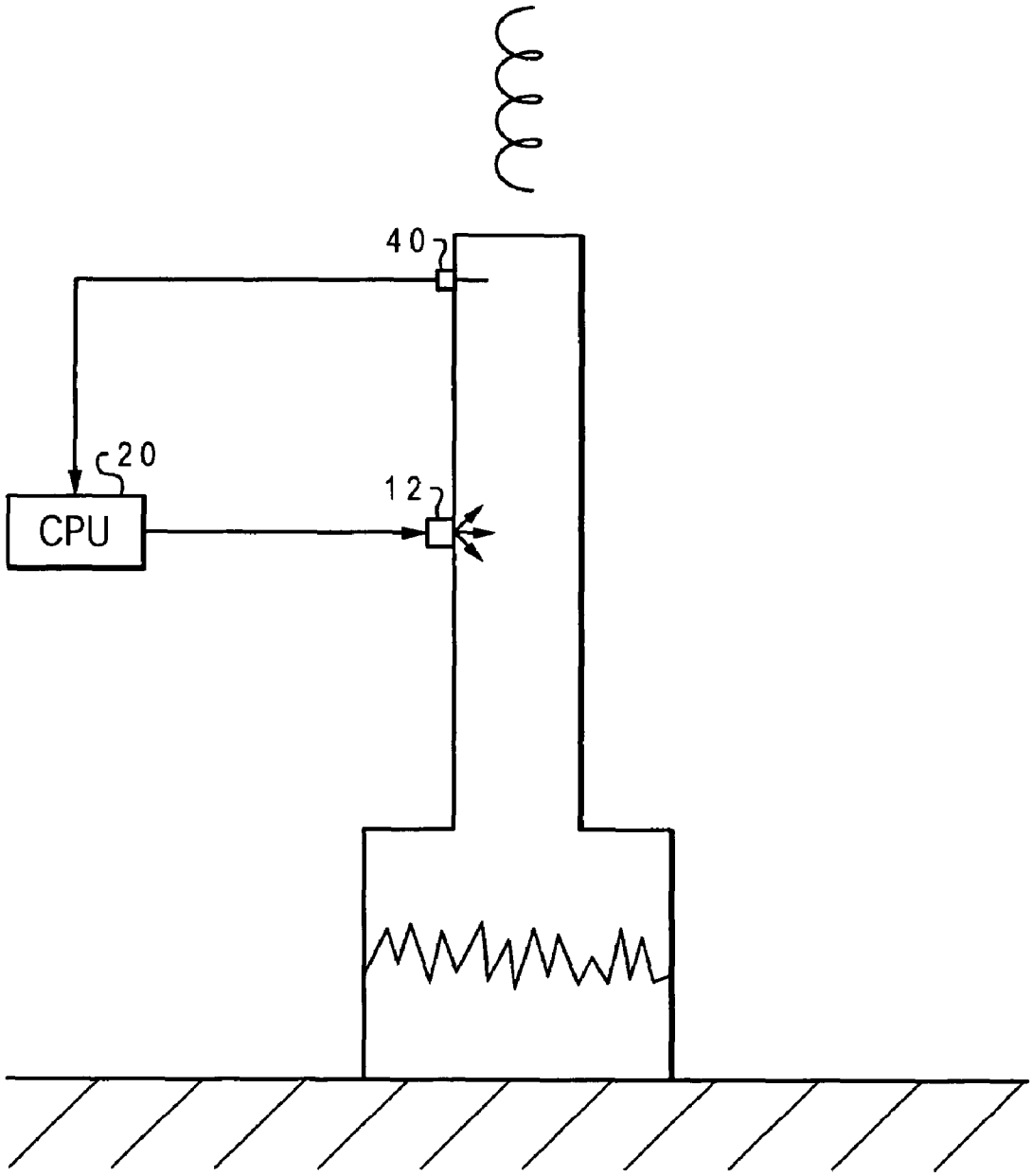
FIG. 5 is an illustration of a fireplace/chimney or furnace/smokestack utilizing the present invention by applying the nuclear resonance stimulation in the exhaust stream.
Figure 6:
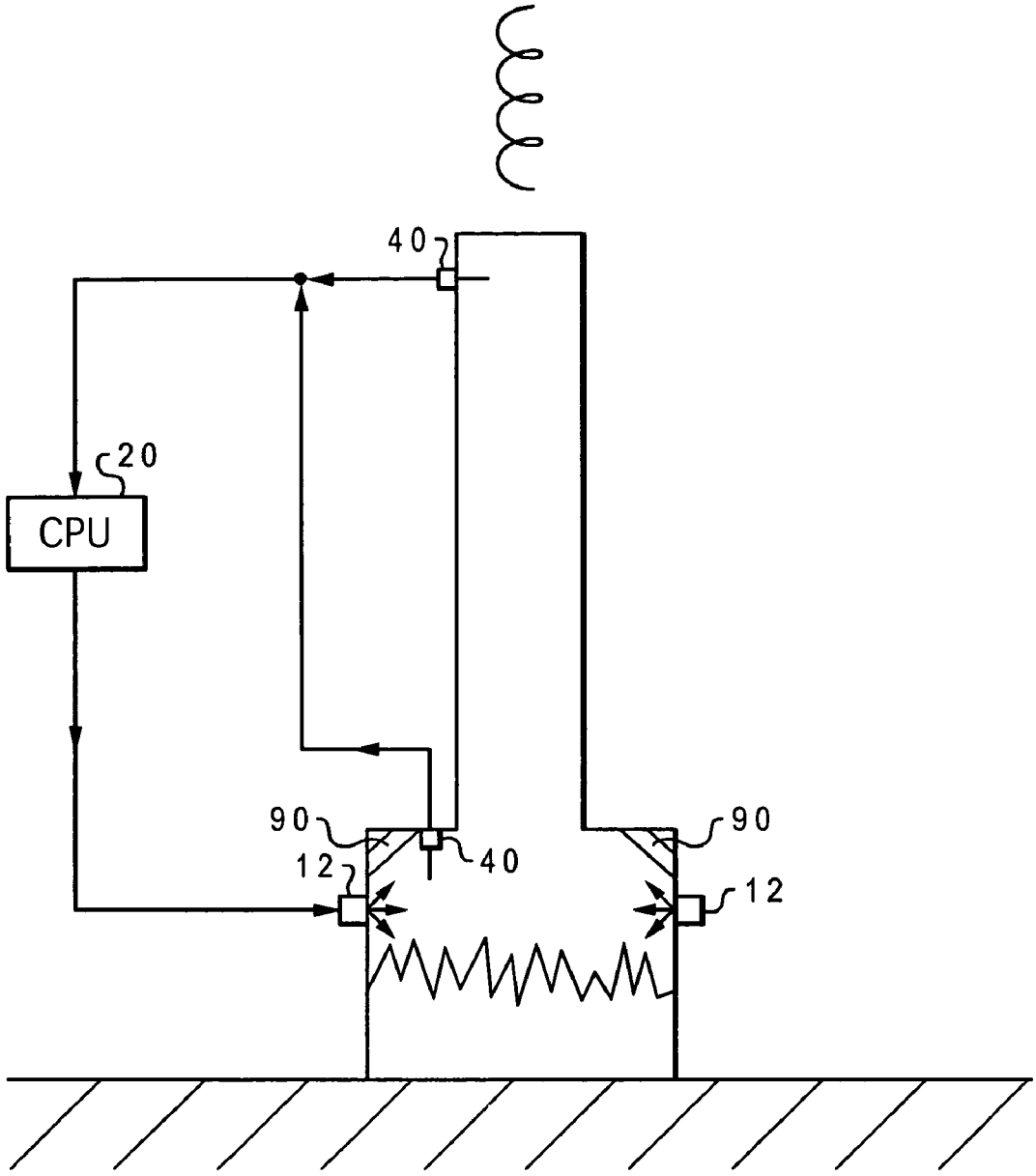
FIG. 6 is similar to FIG. 5 but the invention is utilized by applying the nuclear resonance stimulation in the combustion area.
Figure 7:
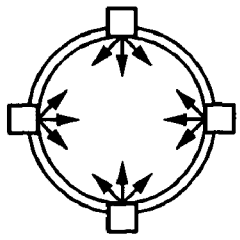
FIG. 7 is a cross-sectional view of the smokestack of FIG. 5 showing the placement of multiple signal sources around the perimeter of the smokestack.

FIGS. 5 and 6 depict more specific examples of how the present invention may be implemented. Both of these figures illustrate a fireplace/chimney or furnace/smokestack with a combustion area and an exhaust stream. In FIG. 5, the nuclear resonance stimulation is applied to the exhaust stream. As seen in FIG. 7, four signal sources 12 are evenly distributed around the perimeter of the smokestack. More or less than four sources could be so used. A sensor near the exit of the exhaust stream provides the feedback data to a central processing unit (CPU) that controls the signal sources. FIG. 6 illustrates a similar application, but the nuclear resonance stimulation is applied to the combustion chamber itself, and the feedback takes into consideration sensory data from both the exhaust stream and the combustion area. The design of FIG. 6 also incorporates signal reflecting material 90 which intensifies the application of the input source signals.

More than one resonant signal source may be induced simultaneously, or in a close time proximity to others, for the purpose of stimulating identical elemental targets as they are combined in different molecular compositions (U.S. Patent Application Publication No. 20030071619 describes a method of using more than one input frequency stimulus simultaneously). For example, NMR stimulation in the intake phase may target H-1 as it is combined in many different hydrocarbon molecules within the fuel stream. To further explain, the composition of gasoline may include over 500 different hydrocarbon molecules. Each may require its own unique resonant stimulus. Ideally, the most abundant molecules of different fuels are targeted. In gasoline, $C_8H_{18}$ (octane), in a low overall proportion, predominates; however, and in order to optimize the desired effects, other $C_5$-$C_{12}$ hydrocarbons in the gasoline mixture can also simultaneously be resonated. A more simplistic example of providing more than one resonate stimulus involves combustion systems that utilize natural gas as the fuel source. Natural gas is mostly (approximately 85%) made up of methane ($CH_4$). Again, ideally, and for increased efficiency, the H-1 component of the other molecular constituents of natural gas—ethane ($C_2H_6$), propane ($C_3H_8$) and butane ($C_4H_{10}$)—can also be simultaneously resonated. In addition, NQR applications applied during the exhaust phase may target N-14 as it occurs in both the NO and $NO_2$ molecules. Individual molecular compositions of these targeted elements will again each have unique input resonant frequency requirements. The option of selective elimination of less abundant molecules is a tradeoff between equipment costs and performance.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. For example, other stimulation sources may be used to produce the desired nuclear resonance, such as an adjustable wavelength laser. It is therefore contemplated that such modifications can be made without departing from the spirit or scope of the present invention as defined in the appended claims.

What is claimed is:

1. A method of carrying out a combustion process, comprising:

initiating a combustion reaction of a combustion material to begin the combustion process;

stimulating one or more components of the combustion material using nuclear resonance to alter the oxidation of one or more selected components of the combustion reaction, the nuclear resonance stimulation having a frequency targeted for the one or more selected components;

iteratively sensing one or more operating parameters of the combustion reaction; and automatically adjusting the frequency of the nuclear resonance stimulation in real-time based on the sensed operating parameters, wherein said adjusting selectively increases or decreases the frequency of the nuclear resonance stimulation by a frequency adjustment value for a preset time of the combustion process.

2. The method of claim 1 wherein said stimulating utilizes nuclear magnetic resonance.

3. The method of claim 1 wherein said stimulating utilizes nuclear quadrupole resonance.

4. The method of claim 1 wherein said stimulating stimulates the one or more components of the combustion material after the combustion reaction in an exhaust stream.

5. The method of claim 1 wherein said stimulating stimulates the one or more components of the combustion material during the combustion reaction in the combustion chamber.

6. The method of claim 1 wherein said stimulating stimulates the one or more components of the combustion material before the combustion reaction in an intake.

7. The method of claim 1 wherein said stimulating stimulates a first component of the combustion material in an intake to the combustion chamber with nuclear magnetic resonance and stimulates a second component of the combustion material in the combustion chamber with nuclear quadrupole resonance.

8. The method of claim 1 wherein said stimulating emits an electromagnetic signal having a frequency which targets a nuclear resonance frequency of nitrogen-14 in the combustion material.

9. The method of claim 1 wherein said stimulating emits an electromagnetic signal having a frequency which targets a nuclear resonance frequency of hydrogen-1 in the combustion material.

10. The method of claim 1 wherein said stimulating emits an electromagnetic pulse which is synchronized with said initiating of the combustion reaction.

11. The method of claim 1 wherein:

said sensing provides information on one or more gas levels in an exhaust stream; and said adjusting tunes the frequency based on the gas level information.

12. The method of claim 1 wherein:

said sensing provides information on temperature in an exhaust stream; and said adjusting tunes the frequency based on the temperature information.

13. The method of claim 1 wherein said adjusting tunes the frequency based on a comparison of at least one current operating parameter to a previously-recorded operating parameter.

14. The method of claim 1 where the nuclear resonance stimulation frequency is a first frequency targeted for a first one of the selected components, and said stimulating further simultaneously uses nuclear resonance stimulation having a second frequency targeted for a second one of the selected components.

15. A combustion apparatus comprising:

a combustion chamber for containing a combustion reaction of a combustion process;

an intake for feeding a combustion material into said combustion chamber;

an exhaust port for carrying an exhaust stream away from said combustion chamber;

a nuclear resonance stimulation source which stimulates one or more components of the combustion material to alter the oxidation of one or more selected components of the combustion reaction, said nuclear resonance stimulation source having a frequency targeted for the one or more selected components;

at least one sensor which iteratively senses one or more operating parameters of the combustion reaction; and a feedback control unit which automatically adjusts the frequency of said nuclear resonance stimulation source in real-time based on the sensed operating parameters by selectively increasing or decreasing the frequency of the nuclear resonance stimulation by a frequency adjustment value for a preset time of the combustion process.

16. The combustion apparatus of claim 15 wherein said nuclear resonance stimulation source is a nuclear magnetic resonance source.

17. The combustion apparatus of claim 15 wherein said nuclear resonance stimulation source is a nuclear quadrupole resonance source.

18. The combustion apparatus of claim 15 wherein said nuclear resonance stimulation source stimulates the one or more components of the combustion material after the combustion reaction in the exhaust stream.

19. The combustion apparatus of claim 15 wherein said nuclear resonance stimulation source stimulates the one or more components of the combustion material during the combustion reaction in said combustion chamber.

20. The combustion apparatus of claim 15 wherein said nuclear resonance stimulation source stimulates the one or more components of the combustion material before the combustion reaction in said intake.

21. The combustion apparatus of claim 15 wherein said nuclear resonance stimulation source includes a nuclear magnetic resonance source which stimulates a first component of the combustion material in said intake and a nuclear quadrupole resonance source which stimulates a second component of the combustion material in said combustion chamber.

22. The combustion apparatus of claim 15 wherein said nuclear resonance stimulation source emits an electromagnetic signal having a frequency which targets a nuclear resonance frequency of nitrogen-14 in the combustion material.

23. The combustion apparatus of claim 15 wherein said nuclear resonance stimulation source emits an electromagnetic signal having a frequency which targets a nuclear resonance frequency of hydrogen-1 in the combustion material.

24. The combustion apparatus of claim 15 wherein said nuclear resonance stimulation source emits an electromagnetic pulse which is synchronized with the combustion reaction.

25. The combustion apparatus of claim 15, further comprising electromagnetic shielding inside combustion chamber which reflects radio frequency signals toward the combustion reaction.

26. The combustion apparatus of claim 15 wherein:

said sensor provides information on one or more gas levels in an exhaust stream; and said feedback control unit adjusts the frequency based on the gas level information.

27. The combustion apparatus of claim 15 wherein:

said sensor provides information on temperature in the exhaust stream; and said feedback control unit adjusts the frequency based on the temperature information.

28. The combustion apparatus of claim 15 wherein said feedback control unit adjusts the frequency based on a comparison of at least one current operating parameter to a previously-recorded operating parameter.

29. The combustion apparatus of claim 15 where the nuclear resonance stimulation source frequency is a first frequency targeted for a first one of the selected components, and said nuclear resonance stimulation source further simultaneously has a second nuclear resonance stimulation source frequency targeted for a second one of the selected components.

30. A feedback control unit for a nuclear resonance stimulation source which enhances a combustion reaction, comprising:

one or more inputs for iteratively receiving sensory data relating to the combustion reaction;

control logic which examines the sensory data to automatically determine an operational adjustment factor for a frequency of the nuclear resonance stimulation source targeted for one or more selected components of the combustion reaction; and an output which provides a real-time signal indicative of the operational adjustment factor.

31. The feedback control unit of claim 30 further comprising a user interface which allows the frequency to be programmably set.

32. The feedback control unit of claim 31 wherein said user interface further allows a frequency adjustment value to be programmably set.

33. The feedback control unit of claim 30 wherein the sensory data relates to information on one or more gas levels in an exhaust stream, and said control logic adjusts the frequency based on the gas level information.

34. The feedback control unit of claim 30 wherein the sensory data relates to information on temperature in an exhaust stream, and said control logic adjusts the frequency based on the temperature information.

35. The feedback control unit of claim 30 wherein said control logic adjusts the frequency based on a comparison of current sensory data to previously-recorded sensory data.

* * * * *